US006622889B2

(12) United States Patent
Dunn

(10) Patent No.: US 6,622,889 B2
(45) Date of Patent: Sep. 23, 2003

(54) SECURE VENDING MACHINE

(76) Inventor: Randall L. Dunn, 3449 Apt J North Druid Hills Rd., Decatur, GA (US) 31716

( * ) Notice: Subject to any disclaimer, the term of this patent is extended or adjusted under 35 U.S.C. 154(b) by 34 days.

(21) Appl. No.: 10/046,835

(22) Filed: Jan. 15, 2002

(65) Prior Publication Data

US 2003/0132238 A1 Jul. 17, 2003

(51) Int. Cl.[7] ..... B65H 3/00

(52) U.S. Cl. ..... 221/192; 221/232

(58) Field of Search ..... 221/191, 192, 221/155, 195, 268, 272, 259, 7, 9, 232

(56) References Cited

U.S. PATENT DOCUMENTS 3,934,754 A * 1/1976 Dutro ..... 221/213
6,439,425 B1 * 8/2002 Masek ..... 221/241

* cited by examiner

*Primary Examiner*—Kenneth W. Noland
(74) *Attorney, Agent, or Firm*—Jackson Walker L.L.P.

(57) ABSTRACT

A vending machine for newspapers has an outer housing, a door, a slot device, an inner housing, a moving plate and a controlling device. The inner housing is secured in the outer housing, and the inner housing is divided into multiple chambers each for receiving one newspaper. The moving plate is moveably attached to the inner housing to close the chamber. The controlling device is attached to the inner housing and controls the moving plate to move relative to the inner housing as the door is opened and then closed. Consequently, the vending machine can limit a buyer to access a quantity of newspapers corresponding exactly to the correct amount of money paid.

19 Claims, 6 Drawing Sheets

SECURE VENDING MACHINE

BACKGROUND OF THE INVENTION

1. Field of the Invention

The present invention relates to a vending machine for newspapers, and more particularly to a secure vending machine for newspapers such that can limit a buyer to get only one newspaper each time the machine is operated.

2. Description of Related Art

Despite enormous increases in information technology media, newspapers still remain very popular due to their convenience in portability and readability. Many people in built-up areas like to get their newspapers at a mass transit place and so on, but one problem in buying newspapers from a store is that people may not have time to line up for a single purchase. Thus, automatic vending machines are available whereby a purchaser can insert some coins into a machine charged with newspapers, and a flap automatically opens to expose the stored newspapers for access by the purchaser. With reference to FIG. 6, a conventional newspaper selling device (60) in accordance with the prior art comprises a housing (62), a door (64) and a slot device (66). The housing (62) contains newspapers. The door (64) is pivotally attached to the housing (62) to close an opening in the housing (62). The slot device (66) receives coins in payment for newspapers and is mounted on the housing (62) to lock the door (64). When a buyer puts the appropriate amount of money into the slot device (66), the slot device (66) will unlock the door (64). The buyer can open the door (64) to get one of the newspapers in the housing (62), and once the door is released after purchase, it swings back to the locked position.

However, there is not any limiting device in the conventional vending machine (60) to limit the buyer to get just one of the newspapers each time as the door (64) is opened. That is, a dishonest person might take several newspapers despite having only paid for one and even though newspapers are not high value articles, there could be a significant loss to the distributor of the newspapers. To overcome the shortcomings, the present invention tends to provide a secure vending machine for newspapers to mitigate or obviate the aforementioned problems.

SUMMARY OF THE INVENTION

The main objective of the invention is to provide a secure vending machine for newspapers that can limit the quantity of newspapers obtainable to exactly the appropriate amount of money inserted into the machine. The vending machine has an outer housing, a door, a slot device, an inner housing, a moving plate and a controlling device. The inner housing is secured in the outer housing, and the inner housing is divided into multiple chambers each for receiving one newspaper. The moving plate is moveably attached to the inner housing to close the chamber. The controlling device is attached to the inner housing and controls the moving plate to move relative to the inner housing as the door is opened and then closed. Consequently, the buyer can get just one newspaper from an exposed chamber in the inner housing, whereby abuse of the vending machine is prevented.

Other objects, advantages and novel features of the invention will become more apparent from the following detailed description when taken in conjunction with the accompanying drawings.

DETAILED DESCRIPTION OF PREFERRED EMBODIMENT

Figure 1:
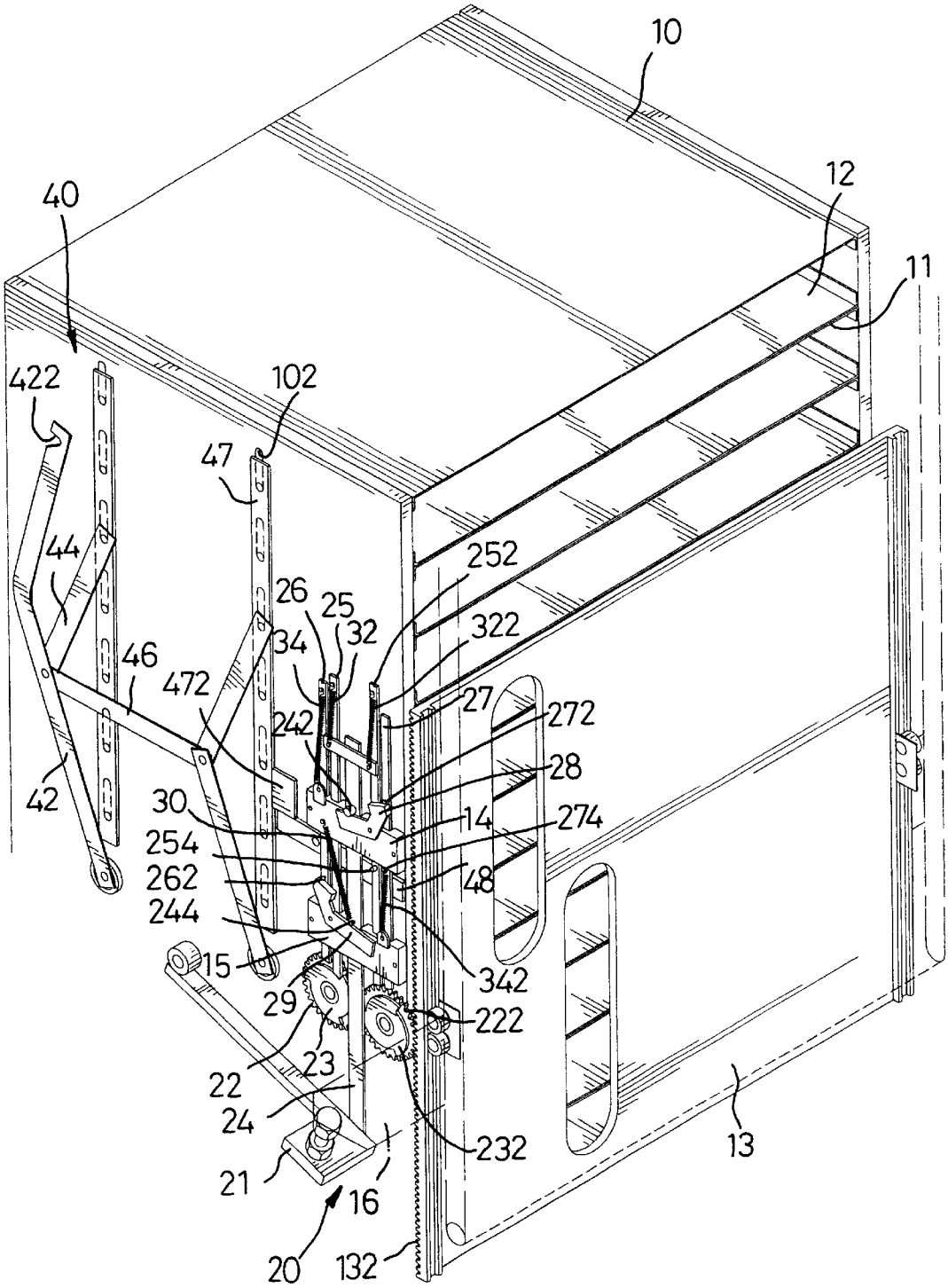
FIG. 1 is a perspective view of an inner housing with a controlling device of a secure vending machine for newspapers in accordance with the present invention.

With reference to FIG. 1, a secure vending machine for newspapers in accordance with the present invention comprises an outer housing, a door, a slot device, an inner housing (10), a moving plate (13) and a controlling device (20). A first opening is defined in the outer housing. The door is pivotally attached to the outer housing to close the first opening. A tab (16) is secured to the door. The slot device is mounted on the outer housing to lock the door. Wherein, the structures of the outer housing, the door and the slot device are similar to the conventional ones. When a person puts appropriate money into the slot device, the slot device will unlock the door and the door is released to permit access to single newspaper.

The inner housing (10) is secured in the outer housing. A second opening is defined in the inner housing (10) and faces the first opening in the outer housing.

Multiple fixed baffles (11) are separately secured in the inner housing (10) to divide the inner housing (10) into multiple chambers. A newspaper is stored in each chamber.

Figure 2:
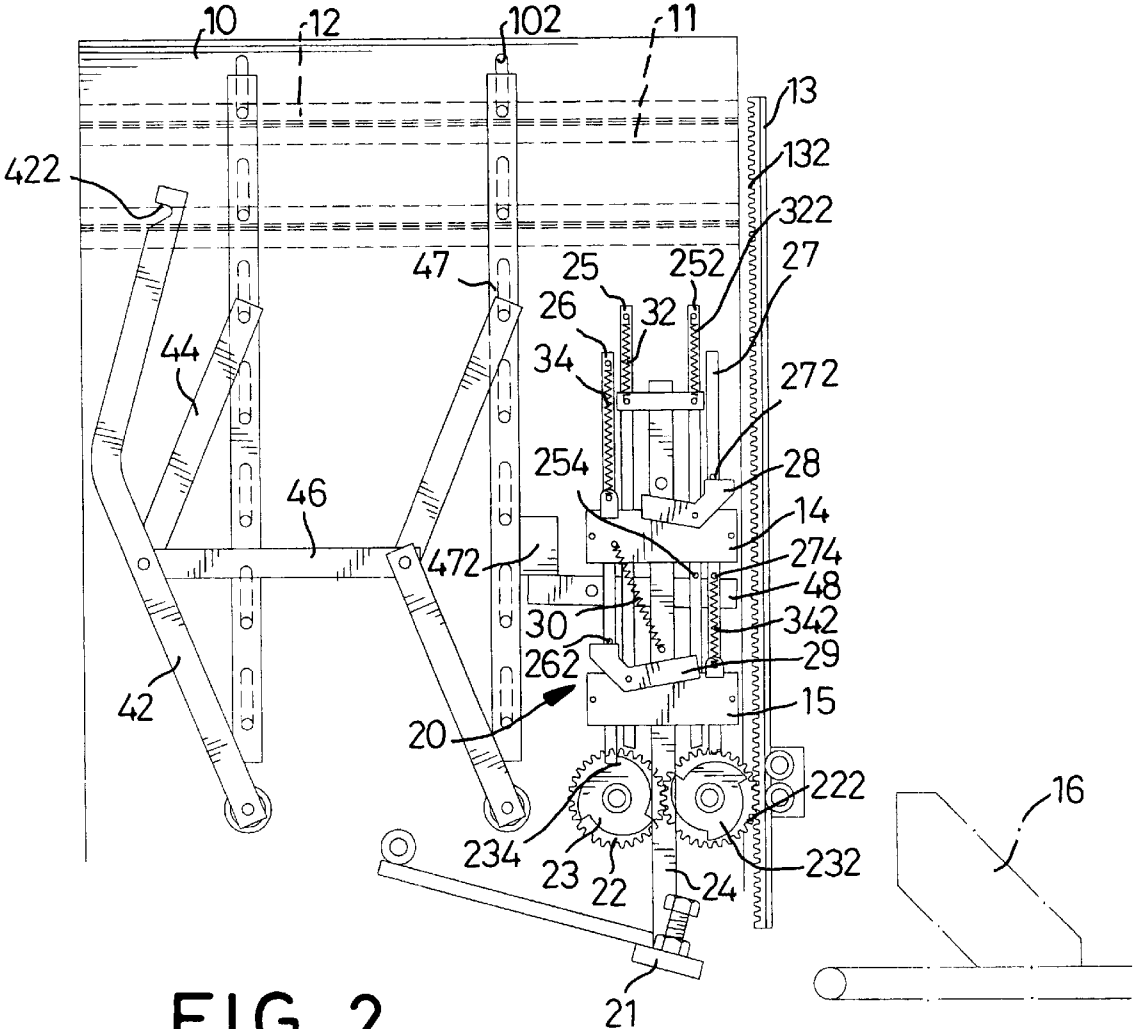
FIG. 2 is an operational side plan view of the inner housing with the controlling device of the vending machine in FIG. 1 as the door is opened.

The moving plate (13) is moveably attached to the inner housing (10) to close the chambers in the inner housing (10). The controlling device (20) is attached on the inner housing (10) to control the moving plate (13) to move relative to the inner housing (10) each time as the door is opened and then closed. With reference to FIGS. 1 and 2, the controlling device (20) comprises a rack (132), two pinions (22,222), a pushed plate (21), a main rod (24), two first bars (25,252) and two second bars (26,27). The rack (132) is longitudinally attached to the moving plate (13) and engages with one of the pinions (22,222). The pinions (22,222) engage with each other. A positioning gear (23,232) is attached to the each respective pinion (22,222). Multiple teeth (234) are formed on the periphery of each respective positioning gear (23,232).

The pushed plate (21) is pivotally attached to the inner housing (10) and corresponds to the tab (16) on the door. The main rod (24) is pivotally attached to the free end of the pushed plate (21). An upper base (14) and a lower base (15) are separately mounted on the inner housing (10) in a longitudinal direction for the main rod (24) extending through the bases (14,15). Consequently, the main rod (24) will longitudinally move relative to the inner housing (10)

when the pushed plate (21) is pushed downward. A main spring (30) is mounted between the main rod (24) and the upper base (14) to provide a force pulling the main rod (24) upward. An upper stub (242) and a lower stub (244) are mounted on the main rod (24) and respectively at the positions above the upper base (14) and the lower base (15). An upper lever (28) is pivotally attached to the upper base (14) and has a first end corresponding to the upper stub (242) on the main rod (24) and a second end. A lower lever (29) is pivotally attached to the lower base (15) and has a first end corresponding to the lower stub (244) on the main rod (24) and a second end.

The first bars (25,252) extend through the upper base (14) and the lower base (15) and are respectively located on two sides of the main rod (24). The two first bars (25,252) respectively align with the positioning gears (23,232) on the two pinions (22,222). A first spring (32,322) is mounted between the main rod (24) and each respective first bar (25,252).

The second bars (26,27) extend through the upper base (14) and the lower base (15) and are respectively located on two sides of the main rod (24). The two second bars (26,27) respectively align with the positioning gears (23,232) on the two pinions (22,222). A second spring (34,342) is mounted between one of the bases (14,15) and each respective second bar (26,27). A pushed pin (262,272) is mounted on each respective second bar (26,27) and corresponds to the second end of one of the upper lever (28) and the lower lever (29).

Figure 3:
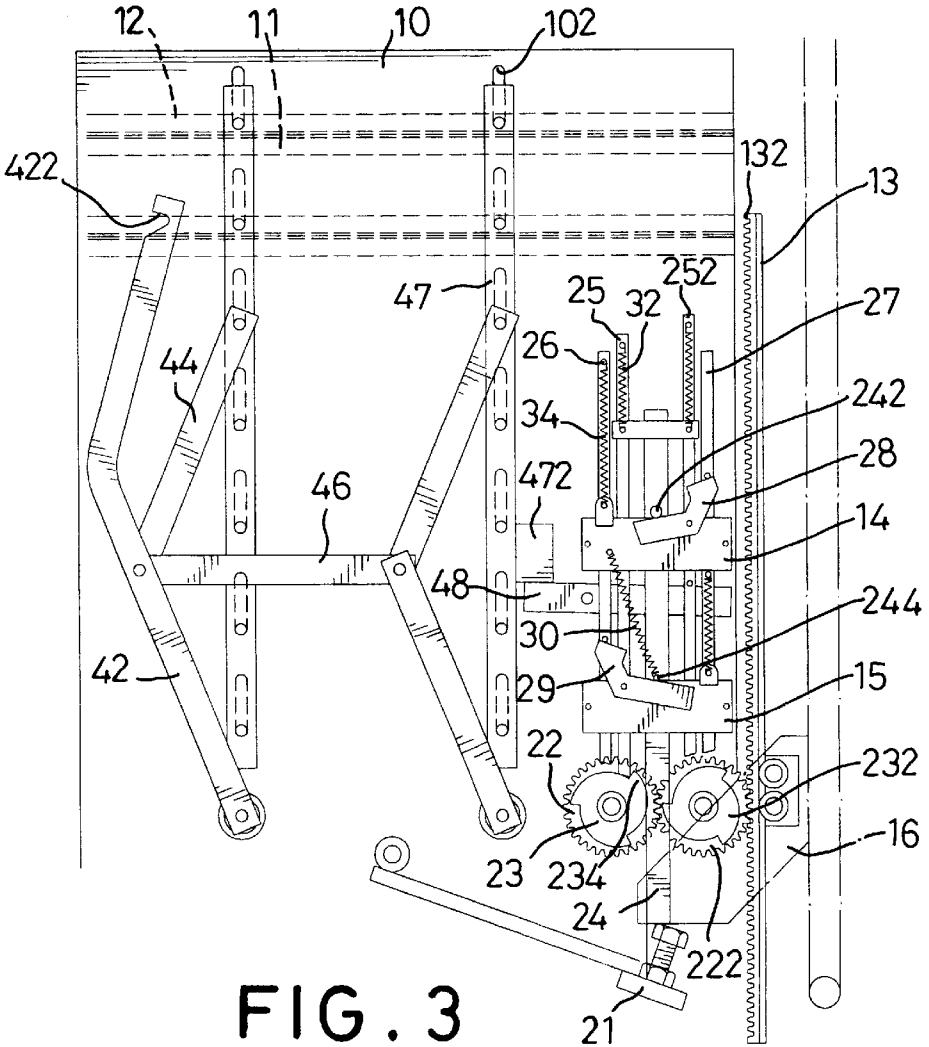
FIG. 3 is an operational side plan view of the inner housing with the controlling device of the vending machine in FIG. 1 as the door is closed.

With reference to FIGS. 1 to 3, when a newspaper buyer puts the appropriate money into the slot device and opens the door, a newspaper can be taken from the topmost exposed chamber. In the meantime, one tooth (234) on one of the positioning gears (23) engages with the corresponding second bar (26) as the left one shown in the figures, such that the pinions (22,222) will not rotate so as to keep the moving plate (13) at a desired position. The first bar (252) and second bar (27) on the other side of the main rod (24), as the right ones shown in the figures, will be stopped by a blocking lever (48). The first bar (252) and the second bar (27) will be kept from moving downward to engage with the teeth (234) on the corresponding positioning gear (232).

When the door is closed, the tab (16) on the door will push the pushed plate (21) downward. The main rod (24) will move downward with the pushed plate (21). The lower stub (244) will push the first end of the lower lever (29), and the second end of the lower lever (29) will push the pushed pin (262) on the second bar (26) to move the second bar (26) upward. The second bar (26) will disengage from the tooth (234) on the positioning gear (23). Consequently, the engaging pinions (22,222) will rotate due to the weight of the moving plate (13) by the transmission of the rack (132). At this time, the first bar (25) will move downward with the main rod (24) by means of the tension of the first spring (30). The pinions (22,222) will be stopped as the other tooth (234) on the positioning gear (23) engages with the first bar (25), such that the moving plate (13) is stopped after the moving plate (13) moves downward a desired distance. This can expose the second chamber in the inner housing (10) for the next buyer to get a newspaper from the exposed chamber. Therefore, one buyer can take only one newspaper from an exposed chamber by means of movement of the moving plate (13), thereby preventing abuse by dishonest people. In general, the newspapers printed on a Sunday or a holiday are much thicker than a newspaper of a normal day. Accordingly, the chambers in the inner housing (10) and the moving distance of the moving plate (13) must be adjustable to receive newspapers of different thicknesses available on certain days. To achieve the adjustment of the chamber, with reference to FIG. 1, a moving baffle (12) is moveably mounted between two adjacent fixed baffles (11), and an adjusting device (40) is mounted on the inner housing (10) to move the moving baffles (12) relative to the inner housing (10). The adjusting device (40) comprises two longitudinal rods (47), two main arms (42), two connecting arms (44) and a lateral arm (46). The two longitudinal rods (47) are secured to each moving baffle (12) with a bolt. A slot (102) is defined in the inner housing (10) for each bolt extending through the slot (102). Consequently, the longitudinal rods (47) and the moving baffles (12) will longitudinally move relative to the inner housing (10) along the slots (102). The two main arms (42) are pivotally attached to the inner housing (10) and parallel to each other. The two connecting arms (44) are respectively pivotally connected to the main arms (42) with a first end. The connecting arms (44) are respectively pivotally connected to the longitudinal rods (47) with a second end. The lateral arm (46) is pivotally connected between the main arms (42). Accordingly, when one of the main arms (42) is pivotally rotated relative to the inner housing (10), the longitudinal rods (47) will move relative to the inner housing (10) by the transmissions of the connecting arms (44) and the lateral arm (46). The moving baffles (12) will move away from or closer to the fixed baffles (11) and the chambers in the inner housing (10) are adjusted. A notch (422) is defined in one of the main arms (42) for the owner of this device to pivotally rotate the main arm (42) by means of a hook hooking on the notch (422). When the owner of this device rotates the main arm (42) with a hook hooking on the notch (422), the moving baffles (12) can be moved relative to the inner housing (10) with the transmission of the adjusting device (40) so as to adjust the chambers in the inner housing (10).

A blocking lever (48) is pivotally attached on the inner housing (10). A blocking plate (472) is secured on one of the longitudinal rods (47) and corresponds to a first end of the blocking lever (48). The second end of the blocking lever (48) corresponds to one of the first bars (252) and one of the second bars (27) at one side of the main rod (24). Two stopping pins (254,274) are respectively mounted on the first bar (252) and the second bar (27) and correspond to the second end of the blocking lever (48). In addition, the teeth (234) on the two positioning gears (23,232) are arranged in an alternating position, i.e. only one tooth (234) on one of the positioning gear (23,232) aligns with the first bars (25,252) and the second bars (26,27).

When the vending machine is used to sell thick newspapers, with reference to FIGS. 1 to 3, the main arms (42) of the adjusting device (40) is rotated to a position where each moving baffle (12) abuts the adjacent fixed baffle (11). Thus, the space defined between two fixed baffles (11) can be used to store a thick newspaper. The blocking plate (472) will push the first end of the blocking lever (48) downward. The second end of the blocking lever (48) will move upward to block the stopping pins (254,274) on the first rod (252) and second rod (27). The first rod (252) and the second rod (27) will not move downward relative to the inner housing (10).

When the door of the newspaper selling device is open, one tooth (234) on the positioning gear (23) that corresponds to the first bar (25) and the second bar (26) on the other side of the main rod (24) will engage with the corresponding second bar (26). The pinions (22,222) will be blocked to keep the moving plate (13) at a desired position. When the door is closed, the main rod (24) will move downward with the pushed plate (21). The second bar (26) engaging with the tooth (234) on the positioning gear (23) will move upward and disengage from the corresponding positioning gear (23). The engaging pinions (22,222) will rotate due to the weight of the moving plate (13) by the transmission of the rack (132). The first bar (25) will move downward with the main rod (24), and the pinions (22,222) will be stopped as the other tooth (234) on the positioning gear (23) engages with the first bar (25), whereby the moving plate (13) moves a desired distance to expose the next chamber.

Figure 4:
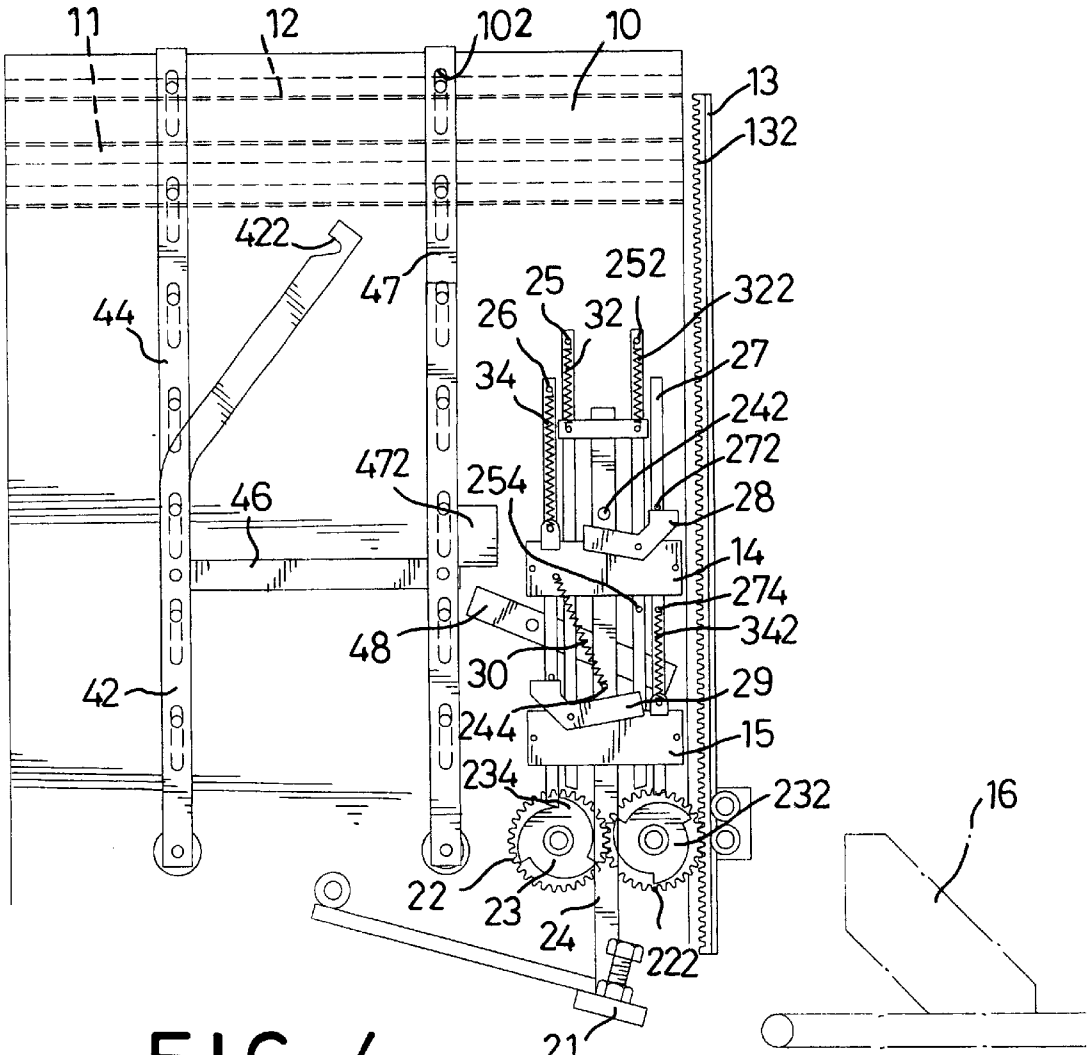
FIG. 4 is an operational side plan view of a second operational embodiment of the inner housing with the controlling device of the vending machine in FIG. 1 as the door is opened.
Figure 5:
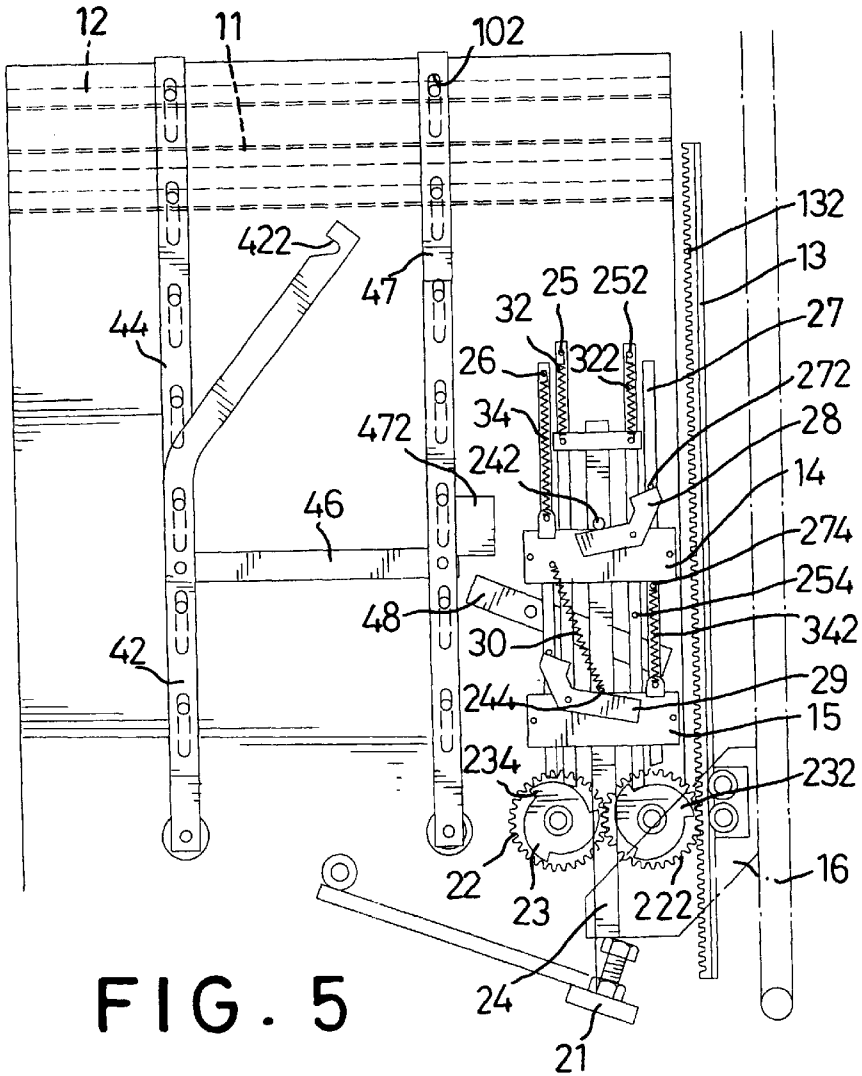
FIG. 5 is an operational side plan view of the second operational embodiment of the inner housing with the controlling device of the vending machine in FIG. 4 as the door is closed.
Figure 6:
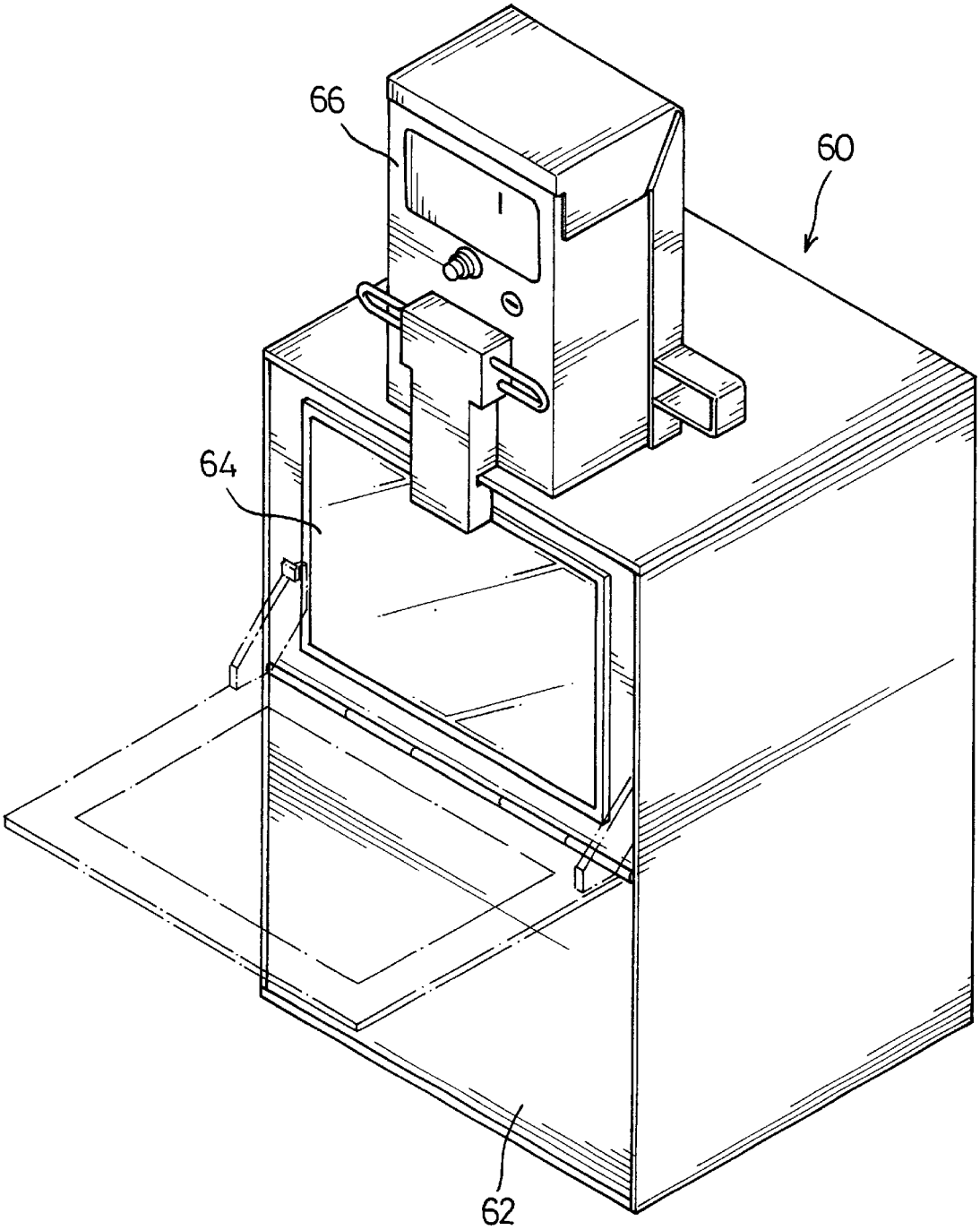
FIG. 6 PRIOR ART
FIG. 6 is a perspective view of a conventional vending machine for newspapers in accordance with the prior art.

When the vending machine is used to sell a thin newspaper, with reference to FIGS. 4 and 5, the main arms (42) are rotated to a position where each moving baffle (12) moves further from the fixed baffle (11) such that the space between two adjacent fixed baffles (11) will be divided into two small chambers each storing a newspaper. As this time, the blocking plate (472) will move upward with the longitudinal rod (47), and the second end of the blocking lever (48) will rotate downward due to the weight of the blocking lever (48). The second end of the blocking lever (48) will leave a position abutting the stopping pins (254,274) on the first rod (252) and the second rod (27). The first rod (252) and the second rod (27) will move downward relative to the inner housing (10) as the main rod (24) moves upward or downward.

When the door is opened and a first buyer takes the newspaper stored in the topmost small chamber in the inner housing, the pushed plate (21) and the main rod (24) will move upward due to the tension of the main spring (30). Both the first bars (25,252) will move upward with the main rod (24) due to the tensions of the two first springs (32,322). Both the second bars (26,27) will move downward due to the tensions of the two second springs (34,342). Because the teeth (234) on the two positioning gears (23,232) are in the alternating arrangement, one of the second bars (26,27) will engage with the tooth (234) on the corresponding positioning gear (23,232). The pinions (22,222) and the moving plate (13) are held by means of the engagement of the second bar (26,27) and the tooth (234) of the corresponding positioning gear (23,232).

When the door is closed, the tab (16) on the door will push the pushed plate (21) and the main rod (24) to move downward. The upper stub (242) and the lower stub (244) will respective push the first ends of the upper lever (28) and the lower lever (29) to lift up the second bars (26,27). Due to the weight of the moving plate (13) through the transmission of the rack (132), the positioning gear (23,232) will be disengaged and the pinions (22,222) will rotate. In the meantime, both of the first bars (25,252) will move downward with the main rod (24). The pinions (22,222) and the moving plate (13) will be stopped as one of the teeth (234) on the other positioning gear (232) engaging with the other first bar (252) as the left one shown in FIG. 5. Therefore, the moving plate (13) will move a half of the original distance to expose the next small chamber. Consequently, when the door of the vending machine is opened and then closed, the moving plate (13) will move a desired small distance.

In addition, if the vending machine is only ever used with newspapers of a constant daily size, i.e. the chambers in the inner housing (10) will not be adjustable, only one pinion (22), one positioning gear (23), one first bar (25), one second bar (26) and one stub (29) are needed. Thus, the structure of the controlling device (20) is simplified.

Furthermore, a second rack (not shown) is mounted on the moving plate (13) at the end apart from the rack (132), and a second pinion (not shown) is mounted on the other side of the inner housing (10) away from the controlling device (20) to engage the rack. With such an arrangement of the second rack and the second pinion, the movement of the moving plate (13) is smooth.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A secure vending machine comprising:

an outer housing with an opening;

a door pivotally attached to the housing to close the opening in the outer housing and having a tab attached to the door;

a slot device mounted on the outer housing to lock the door;

an inner housing secured in the inner housing and having an opening facing to the door;

multiple fixed baffles separately secured in the inner housing to divide the housing into multiple chambers;

a moving plate movably attached to the inner housing to close the chambers in the inner housing;

a controlling device attached to the inner housing to control the moving plate to move relative to the inner housing each time as the door is closed and having:

one pinion rotatably attached to the inner housing;

a rack longitudinally attached to the moving plate and engaging with the pinion;

a positioning gear with multiple teeth attached to the pinion;

a pushed plate pivotally attached to the inner housing and corresponding to the tab on the door;

a main rod securely attached to the pushed plate and moveably relative to the inner housing;

a main spring mounted on the main rod to provide a force pulling the main rod to move the main rod upward;

a first bar moveably attached to the inner housing and aligning with the positioning gear;

a first spring mounted between the main rod and the first bar to move the first bar with the main rod;

a second bar moveably attached to the inner housing, adjacent to the first bar and aligning with the positioning gear;

a second spring mounted on the second bar to provide a force to the second bar to move the second bar downward;

a lever pivotally attached to the inner housing to lift the second bar to move upward as the main rod moves downward.

2. The secure vending machine as claimed in claim 1, wherein a stub is mounted on the main rod;

a pushed pin is mounted on the second bar; and the lever has a first end corresponding to the stub on the main rod and a second end corresponding to the pushed pin on the second bar, whereby the second bar will be lifted upward by means of the second end of the lever abutting the pushed pin as the main rod moves downward and the stub pushes the first end of the lever.

3. The secure vending machine as claimed in claim 1, wherein a second rack is mounted on the moving plate at an end far away from the rack; and a second pinion is rotatably mounted on the inner housing at a side far away from the controlling device and engages with the second rack.

4. The secure vending machine as claimed in claim 1 further comprising an upper base and a lower base separately mounted on the inner housing in a longitudinal direction for the main rod, the first bar and the second bar extending through the upper base and the lower base.

5. The secure vending machine as claimed in claim 4, wherein the lever is pivotally attached to the lower base; and the stub mounted on the main rod is located at a position above the lower base.

6. The secure vending machine as claimed in claim 4, wherein the second spring is mounted between the second bar and the upper base.

7. The secure vending machine as claimed in claim 4, wherein the main spring is mounted between main rod and the upper base.

8. A vending device for newspapers comprising:

an outer housing with an opening;

a door pivotally attached to the housing to close the opening in the outer housing and having a tab attached to the door;

a slot device mounted on the outer housing to lock the door;

an inner housing secured in the inner housing and having an opening facing to the door;

multiple fixed baffles separately secured in the inner housing to divide the housing into multiple chambers;

a moving plate movably attached to the inner housing to close the chambers in the inner housing;

a controlling device attached to the inner housing to control the moving plate to move relative to the inner housing each time as the door is closed and having:

two pinions rotatably attached to the inner housing and engaging with each other;

a rack longitudinally attached to the moving plate and engaging with one of the pinions;

a positioning gear with multiple teeth attached to each respective pinion;

a pushed plate pivotally attached to the inner housing and corresponding to the tab on the door;

a main rod securely attached to the pushed plate and moveably relative to the inner housing;

a main spring mounted on the main rod to provide a force pulling the main rod to move the main rod upward;

two first bars moveably attached to the inner housing and respectively aligning with the positioning gears;

a first spring mounted between the main rod and each respective first bar to move the first bar with the main rod;

two second bars moveably attached to the inner housing and respectively aligning with the positioning gears;

a second spring mounted on each respective second bar to provide a force to the second bar to move the second bar downward;

an upper lever pivotally attached to the inner housing to lift a first of the second bars to move upward as the main rod moves downward; and a lower lever pivotally attached to the inner housing to lift a second of the second bars to move upward as the main rod moves downward.

9. The vending device as claimed in claim 8, wherein an upper stub is mounted on the main rod;

a lower stub is mounted on the main rod;

a pushed pin is mounted on each respective second bars;

the upper lever has a first end corresponding to the upper stub and a second end corresponding to the pushed pin on one of the second bars; and the lower lever has a first end corresponding to the lower stub and a second end corresponding to the pushed pin on the other second bar, whereby the second bars will be lifted upward by means of the second ends of the upper lever and the lower lever abutting the pushed pins as the main rod moves downward.

10. The vending device as claimed in claim 8, wherein a second rack is mounted on the moving plate at an end far away from the rack; and a second pinion is rotatably mounted on the inner housing at a side far away from the controlling device and engages with the second rack.

11. The vending device as claimed in claim 8 further comprising an upper base and a lower base separately mounted on the inner housing in a longitudinal direction for the main rod, the first bars and the second bars extending through the upper base and the lower base.

12. The vending device as claimed in claim 11, wherein the upper lever is pivotally attached to the upper base;

the lower lever is pivotally attached to the lower base;

the upper stub mounted on the main rod is located a position above the upper base; and the lower stub mounted on the main rod is located a position above the lower base.

13. The vending device as claimed in claim 8, wherein a first of the second springs is mounted between one of the second bars and the upper base; and a second of the second springs is mounted between the other second bar and the lower base.

14. The vending device as claimed in claim 11, wherein the main spring is mounted between main rod and the upper base.

15. The vending device as claimed in claim 11 further comprising a moving baffle moveably mounted in the inner housing and between each adjacent fixed baffle;

an adjusting device mounted on the inner housing to control the moving baffles to move relative to the inner housing; and a blocking device arranged between the adjusting device and a first of the first bars and one of the second bars to keep the first bar and the second bar from moving downward, wherein the teeth on the two positioning gears are arranged in an alternative position.

16. The vending device as claimed in claim 15, wherein the adjusting device comprises:

two longitudinal rods secured to the moving baffles;

two main arms pivotally attached to the inner housing and parallel to each other;

two connecting arms respectively pivotally connected to the main arms with a first end and respectively pivotally connected to the longitudinal rods with a second end; and a lateral arm pivotally connected between the main arms.

17. The vending device as claimed in claim 16, wherein a notch is defined in one of the main arms adapted for a hook hooking on the notch.

18. The vending device as claimed in claim 16, wherein each longitudinal rod is secured to each moving baffle with a bolt;

a slot is defined in the inner housing for each bolt connected to one of the moving baffles extending through the slot.

19. The vending device as claimed in claim 16, wherein the blocking device comprises:

a blocking lever pivotally attached on the inner housing and having a first end and a second end corresponding to one of the first bars and one of the second bars;

a blocking plate secured on one of the longitudinal rods and corresponding to the first end of the blocking lever;

two stopping pins respectively mounted on one of the first bars and one of the second bars and corresponding to the second end of the blocking lever.

* * * * *